US010954618B2

(12) United States Patent
Lee et al.

(10) Patent No.: US 10,954,618 B2
(45) Date of Patent: Mar. 23, 2021

(54) LAUNDRY TREATMENT APPARATUS WITH DRAWER LOCKING UNIT

(71) Applicant: LG Electronics Inc., Seoul (KR)

(72) Inventors: Jihong Lee, Seoul (KR); Wooseong Kim, Seoul (KR); Inbo Sim, Seoul (KR); Gunho Lee, Seoul (KR); Inhee Han, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

(21) Appl. No.: 16/186,175

(22) Filed: Nov. 9, 2018

(65) Prior Publication Data

US 2019/0078249 A1 Mar. 14, 2019

Related U.S. Application Data

(62) Division of application No. 15/058,258, filed on Mar. 2, 2016, now Pat. No. 10,125,442.

(30) Foreign Application Priority Data

Mar. 2, 2015 (KR) ..... 10-2015-0028983
Jan. 5, 2016 (KR) ..... 10-2016-0000986

(51) Int. Cl.
*D06F 29/00* (2006.01)
*D06F 37/28* (2006.01)
(Continued)

(52) U.S. Cl.
CPC ..... *D06F 29/00* (2013.01); *D06F 31/00* (2013.01); *D06F 37/28* (2013.01); *D06F 39/14* (2013.01);
(Continued)

(58) Field of Classification Search
CPC ..... D06F 37/10; D06F 37/18; D06F 37/28; D06F 39/14; D06F 29/00; D06F 31/00;
(Continued)

(56) References Cited

U.S. PATENT DOCUMENTS 6,732,552 B2 5/2004 Kim et al.
8,234,889 B2 8/2012 Kim et al.
(Continued)

FOREIGN PATENT DOCUMENTS

CH 673310 2/1990
CN 102844486 12/2012
(Continued)

OTHER PUBLICATIONS

International Search Report and Written Opinion in International Application No. PCT/KR2016/002029, dated May 18, 2016, 17 pages.
(Continued)

*Primary Examiner* — Joseph L. Perrin
(74) *Attorney, Agent, or Firm* — Fish & Richardson P.C.

(57) ABSTRACT

A laundry treatment apparatus includes a drawer. The laundry treatment apparatus further includes a cabinet that has an entrance opening and that is configured to receive the drawer through the entrance opening. The laundry treatment apparatus further includes a drum that is located inside the drawer and that is configured to receive laundry. The laundry treatment apparatus further includes a drum drive unit that is located inside the drawer and that is configured to rotate the drum. The laundry treatment apparatus further includes a fastening mechanism that is configured to reciprocate in a first direction that is either up and down or left and right with respect to a front of the drawer. The laundry treatment apparatus further includes a transfer member that is configured to reciprocate in a second direction that is either up and down or left and right with respect to the front of the drawer.

16 Claims, 13 Drawing Sheets

(51) Int. Cl.

| | |
|---|---|
| ***D06F 39/14*** | (2006.01) |
| ***D06F 31/00*** | (2006.01) |
| *D06F 37/10* | (2006.01) |
| *D06F 37/18* | (2006.01) |
| *E05B 65/46* | (2017.01) |
| *E05C 9/04* | (2006.01) |
| *E05B 47/00* | (2006.01) |
| *E05C 1/00* | (2006.01) |
| *E05B 65/44* | (2006.01) |
| *E05C 1/16* | (2006.01) |

(52) U.S. Cl.
CPC ..... *D06F 37/10* (2013.01); *D06F 37/18* (2013.01); *E05B 47/0012* (2013.01); *E05B 65/44* (2013.01); *E05B 65/46* (2013.01); *E05C 1/00* (2013.01); *E05C 1/16* (2013.01); *E05C 9/042* (2013.01); *E05C 9/045* (2013.01)

(58) Field of Classification Search
CPC ... E05C 1/00; E05C 1/16; E05C 9/045; E05B 65/44; E05B 65/46
See application file for complete search history.

(56) References Cited

U.S. PATENT DOCUMENTS

| | | | | |
|---|---|---|---|---|
| 2002/0056293 | A1 | 5/2002 | Kim et al. | |
| 2004/0017088 | A1 | 1/2004 | Sawatani et al. | |
| 2004/0093913 | A1 | 5/2004 | Bolduan et al. | |
| 2008/0092606 | A1 | 4/2008 | Meekma | |
| 2009/0113945 | A1 | 5/2009 | Kim et al. | |
| 2009/0139275 | A1 | 6/2009 | Kim et al. | |
| 2009/0145175 | A1 | 6/2009 | Kim et al. | |
| 2010/0307200 | A1* | 12/2010 | Jeong | D06F 39/12 68/13 R |
| 2011/0265524 | A1 | 11/2011 | Kim et al. | |
| 2013/0229098 | A1 | 9/2013 | Pletcher | |
| 2014/0053612 | A1* | 2/2014 | Son | D06F 29/00 68/28 |
| 2014/0196507 | A1* | 7/2014 | Lee | D06F 31/00 68/27 |
| 2014/0210219 | A1 | 7/2014 | Pipp | |
| 2014/0225379 | A1 | 8/2014 | Fukumoto | |
| 2015/0233038 | A1 | 8/2015 | Lee et al. | |
| 2015/0233039 | A1 | 8/2015 | Cho et al. | |
| 2015/0233042 | A1 | 8/2015 | Kang et al. | |
| 2015/0233043 | A1 | 8/2015 | Sim et al. | |

FOREIGN PATENT DOCUMENTS

| | | |
|---|---|---|
| CN | 104250906 | 12/2014 |
| DE | 3128701 | 2/1983 |
| DE | 8518172 | 8/1985 |
| DE | 10109533 | 9/2002 |
| EP | 1236851 | 9/2002 |
| FR | 2520037 | 7/1983 |
| GB | 2187497 | 9/1987 |
| JP | 09-041806 | 2/1997 |
| JP | 2002-285746 | 10/2002 |

OTHER PUBLICATIONS

Extended European Search Report issued in European Application No. 16158045.1 dated Aug. 2, 2016, 10 pages.
Chinese Office Action in Chinese Application No. 201610115882.5, dated Aug. 3, 2017, 20 pages (with English translation).

* cited by examiner

FIG. 3(a)
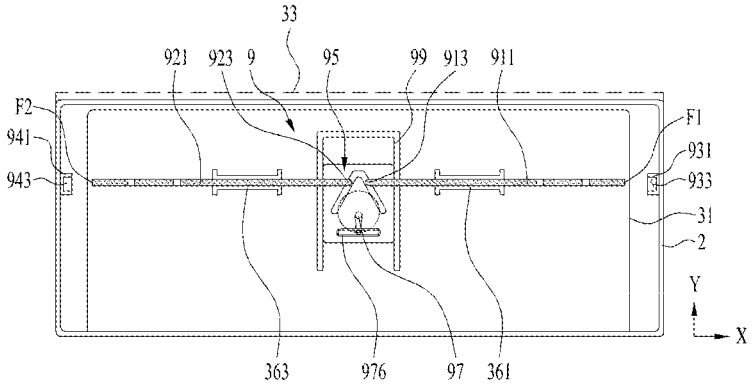
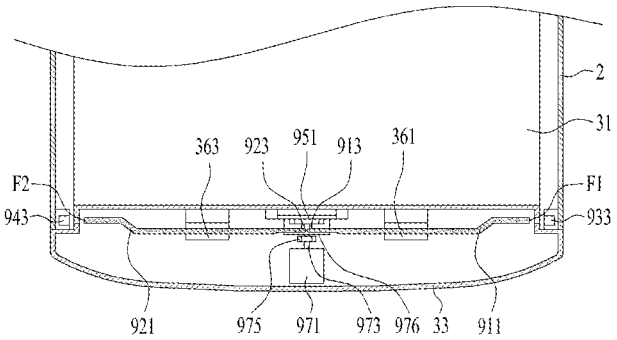
FIG. 3(b)

FIG. 5(a)
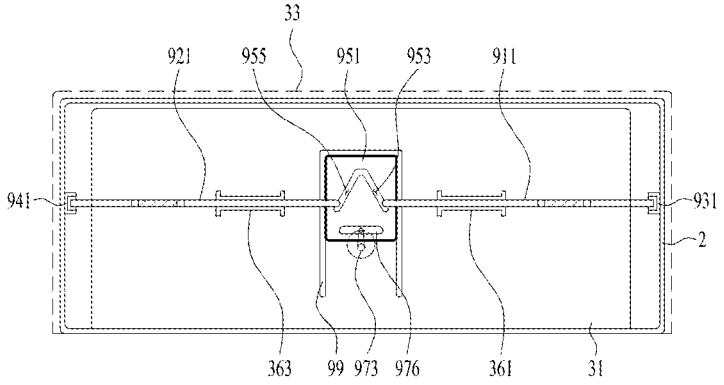
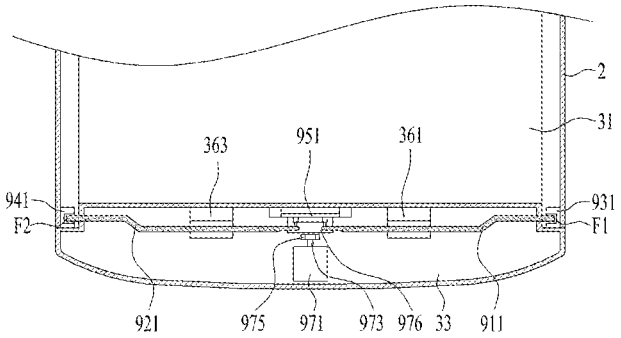
FIG. 5(b)

LAUNDRY TREATMENT APPARATUS WITH DRAWER LOCKING UNIT

CROSS REFERENCE TO RELATED APPLICATIONS

This application is a divisional application of U.S. application Ser. No. 15/058,258, filed on Mar. 2, 2016, which claims the benefit of Korean Patent Application Nos. 10-2015-0028983, filed on Mar. 2, 2015 and 10-2016-0000986, filed on Jan. 5, 2016, all of which are hereby incorporated by reference as if fully set forth herein.

FIELD

The present disclosure relates to a laundry treatment apparatus.

BACKGROUND

Generally, a laundry treatment apparatus is a generic term for an apparatus that washes laundry (e.g. objects to be washed or objects to be dried), an apparatus that dries laundry, and an apparatus that may perform both washing and drying of laundry.

In the case of a front loading type laundry treatment apparatus (referred to as a drum washing machine) configured to introduce laundry through the front side of the apparatus, a laundry opening is formed at a height lower than the waist of a user, which requires the user to bend his/her body when introducing or retrieving laundry into or from the laundry treatment apparatus.

SUMMARY

According to an innovative aspect of the subject matter described in the application, a laundry treatment apparatus includes: a drawer; a cabinet that has an entrance opening and that is configured to receive the drawer through the entrance opening; a drum that is located inside the drawer and that is configured to receive laundry; a drum drive unit that is located inside the drawer and that is configured to rotate the drum; a fastening mechanism that is configured to reciprocate in a first direction that is either up and down or left and right with respect to a front of the drawer and that is configured to separably couple the drawer to the cabinet; and a transfer member that is configured to reciprocate in a second direction that is either up and down or left and right with respect to the front of the drawer and that is configured to move the fastening mechanism, the second direction being different than the first direction.

The laundry treatment apparatus may include or more of the following optional features. The fastening mechanism includes: a first bar that is configured to reciprocate up and down with respect to the front of the drawer in response to the transfer member moving and that is separably coupled to a first surface of the cabinet; and a second bar that is configured to reciprocate up and down with respect to the front of the drawer in response to the transfer member moving and that is separably coupled to a second surface of the cabinet that is opposite the first surface. The fastening mechanism includes: a first bar that is configured to reciprocate left and right with respect to the front of the drawer in response to the transfer member moving and that is separably coupled to a first surface of the cabinet; and a second bar that is configured to reciprocate up and down with respect to the front of the drawer in response to the transfer member moving and that is separably coupled to a second surface of the cabinet that is opposite the first surface. The fastening mechanism includes: a first bar that is configured to reciprocate left and right with respect to the front of the drawer in response to the transfer member moving and that is separably coupled to a first surface of the cabinet; and a second bar that is configured to reciprocate left and right with respect to the front of the drawer in response to the transfer member moving and that is separably coupled to a second surface of the cabinet that is opposite the first surface.

The laundry treatment apparatus includes: a first bar guide located in the drawer and configured to support the first bar; and a second bar guide located in the drawer and configured to support the second bar. The first bar includes: a first coupling portion that is connected to the transfer member; and a first end that is configured to separably couple to the cabinet. The second bar includes: a second coupling portion that is connected to the transfer member; and a second end that is configured to separably couple to the cabinet. The transfer member includes: a transfer body that is configured to reciprocate up and down with respect to the drawer and that defines a first slot and a second slot. The first coupling portion is configured to connect to the first slot that is configured to guide the first bar left and right with respect to the front of the drawer. The second coupling portion is configured to connect to the second slot that is configured to guide the second bar left and right with respect to the front of the drawer. The first slot and the second slot are angled relative to a movement direction of the transfer body by a prescribed angle. A distance between an upper end of the first slot and an upper end of the second slot is less than a distance between a lower end of the first slot and a lower end of the second slot. The laundry treatment apparatus includes: a transfer member guide that is located in the drawer and that is configured to guide movement of the transfer body.

The laundry treatment apparatus includes: a motor that has a rotating shaft; and a converter that is configured to convert rotation motion of the rotating shaft into reciprocation motion of the transfer body. The converter includes: a body slot in the transfer body that is orthogonal to a reciprocating movement direction of the transfer body; an arm that is connected to the rotating shaft; and a slot connection portion that is located on the arm. The body slot is configured to receive the slot connection portion. A length of the body slot is equal to or greater than a diameter of a movement path of the slot connection portion. The laundry treatment apparatus includes: a tub that is located inside the drawer and that is configured to receive the drum; and a drive shaft that is configured to penetrate the tub and that is configured to connect to a bottom surface of the drum. The drum drive unit includes: a rotor that is configured to connect to the drive shaft; and a stator that is located on a lower surface of the tub and that is configured to rotate the rotor. The fastening mechanism is located above the drum drive unit. The drawer includes: a drawer body that defines a space that is configured to receive the drum; and a drawer panel that is configured to open or close the entrance opening and that is separably coupled to the drawer body. The fastening mechanism and the transfer member are connected to the drawer body and are visible based on the drawer panel being separated from the drawer body.

According to another innovative aspect of the subject matter described in the application, a laundry treatment apparatus includes: a cabinet that has an entrance opening; a drawer body that includes a first surface that is parallel to the entrance opening, a second surface that extends from a first end of the first surface, and a third surface that extends from a second, opposite end of the first surface, where the cabinet is configured to receive the drawer body through the entrance opening; a tub that is located inside the drawer body, that defines a space that is configured to store water, and that has a curved outer circumferential surface that is adjacent to the first surface, the second surface, and the third surface; a drum that is located inside the tub, that is configured to rotate, and that is configured to receive laundry; a first bent portion that protrudes from the first surface into a space that is between the second surface of the drawer body and the outer circumferential surface of the tub; a second bent portion that protrudes from the first surface into a space that is between the third surface of the drawer body and the outer circumferential surface of the tub; a transfer member that is located on the first bent portion and that is configured to reciprocate up and down with respect to the drawer body; a first fastening member that is configured to reciprocate left and right with respect to a front of the drawer body in response to the transfer member moving, and that is separably coupled to a portion of an inner circumferential surface of the cabinet that is parallel to the second surface of the drawer body; and a second fastening member that is configured to reciprocate left and right with respect to the front of the drawer body in response to the transfer member moving, and that is separably coupled to a portion of the inner circumferential surface of the cabinet that is parallel to the third surface.

The laundry treatment apparatus may include or more of the following optional features. The first fastening member includes: a first bar that is configured to reciprocate left and right with respect to the front of the drawer body in response to the transfer member moving; a first coupling portion that connects the first bar to the transfer member; and a first end that is separably coupled to the cabinet. The second fastening member includes: a second bar configured to reciprocate left and right with respect to the front of the drawer body in response to the transfer member moving; a second coupling portion that connects the second bar to the transfer member; and a second end that is separably coupled to the cabinet. The second bar includes: a bar body that is located on the second coupling portion and that is located on the first bent portion; a separable coupling bar portion that is located on the second end and that is located on the second bent portion; a connection body that is parallel to the first surface of the drawer body; a first inclined portion that connects the bar body with the connection body and that is inclined toward the first bent portion; and a second inclined portion that connects the separable coupling bar portion with the connection body and that is inclined toward the second bent portion.

The transfer member includes: a transfer body that is configured to reciprocate up and down with respect to a front of the drawer body and that defines a first slot and a second slot. The first coupling portion is coupled to the first slot. The first slot is configured to guide movement of the first bar in a direction in which the first end is secured to the cabinet in response to the transfer body moving in a first direction. The first slot is configured to guide movement of the first bar in a direction in which the first end is separated from the cabinet in response to the transfer body moving in a second direction. The second coupling portion is coupled to the second slot. The second slot is configured to guide movement of the second bar in a direction in which the second end is secured to the cabinet in response to the transfer body moving in the first direction. The second slot is configured to guide movement of the second bar in a direction in which the second end is separated from the cabinet in response to the transfer body moving in the second direction. The laundry treatment apparatus includes: a motor that has a rotating shaft; a body slot in the transfer body that is perpendicular to a reciprocating movement direction of the transfer body; an arm that is connected to the rotating shaft; and a slot connection portion that is located on the arm. The body slot is configured to receive the slot connection portion.

A length of the body slot is equal to or greater than a diameter of a movement path formed by the slot connection portion. The laundry treatment apparatus includes: a transfer body guide that is located on the first bent portion and that is configured to guide movement of the transfer body. The laundry treatment apparatus includes: a first receiving piece that is located in the cabinet, that separably couples the first end to the first receiving piece, and that is spaced apart from the entrance opening by a first prescribed distance; and a second receiving piece that is located in the cabinet, that separably couples the second end to the second receiving piece, and that is spaced apart from the entrance opening by a second prescribed distance. The laundry treatment apparatus includes: a first guide that is located on the first surface and that is configured to guide movement of the second bar. The laundry treatment apparatus includes: a drawer panel that is connected to the drawer body and that is configured to open or close the entrance opening; and a second guide that protrudes from the drawer panel toward the second bar and that is configured to maintain separation between the second bar and the first surface. The laundry treatment apparatus includes: a drawer panel that is connected to the drawer body and that is configured to open or close the entrance opening; a third guide body that extends from the second surface toward the drawer panel; a third guide body through-hole that is formed in the third guide body and that is configured to receive the first end; a fourth guide body that extends from the third surface toward the drawer panel; and a fourth guide body through-hole that is formed in the fourth guide body and that is configured to receive second end.

The laundry treatment apparatus includes: a drawer panel that includes a panel front surface that is parallel to a surface of the cabinet that defines the entrance opening, that includes a first side surface that extends from a first end of the panel front surface toward the cabinet, that includes a second side surface that extends from a second, opposite end of the panel front surface toward the cabinet, and a panel upper surface that is located on a top of the panel front surface; a drive unit that is configured to operate the transfer member; and an unlocking unit that is located on one of the first side surface or the second side surface, that is configured to control the drive unit, and that is configured to separate the first fastening member and the second fastening member from the cabinet. The drive unit is configured to reciprocate the transfer member up and down with respect to a front of the drawer body. The laundry treatment apparatus includes: a drum drive unit that is configured to rotate the drum; a control panel that is located on the panel upper surface and that is configured to receive a first control command that operates the drum drive unit; and a controller that is configured to control the drum drive unit in response to a second control command that is input via the control panel and to control the drive unit in response to a third control command that is input via the unlocking unit.

The laundry treatment apparatus includes: a second cabinet that is located on a top of the cabinet and that is configured to prevent at least a portion of the control panel from being visible based on the drawer body being inside the cabinet; and a second laundry accommodation structure that is located inside the second cabinet and that defines a space that is configured for washing or drying laundry. The drawer panel includes: a panel through-hole that is formed in one of the first side surface or the second side surface. The unlocking unit includes: a support portion that is connected to an inside of the drawer panel; a pressure portion that is configured to be inserted into the panel through-hole; a signal generator that is configured to transmit a control signal to the controller in response to the pressure portion being inserted into the drawer panel; and an expanded portion that is configured to connect the support portion with the pressure portion, that has a larger diameter than the panel through-hole, and that is located between the panel through-hole and the signal generator. The controller is configured to separate the first fastening member and the second fastening member from the cabinet and stop operation of the drum drive unit in response to a control command that is input via the unlocking unit by controlling the drive unit.

One object of the subject matter disclosed in this application is to provide a laundry treatment apparatus, which may perform washing or drying of laundry using a drawer that may be discharged from a cabinet.

In addition, another object of the subject matter disclosed in this application is to provide a laundry treatment apparatus, which may minimize vibration of a drawer within a cabinet while laundry is washed or dried.

In addition, another object of the subject matter disclosed in this application is to provide a laundry treatment apparatus, which may prevent a drawer from being discharged from a cabinet while laundry is washed or dried.

In addition, another object of the subject matter disclosed in this application is to provide a laundry treatment apparatus, which may have a minimum volume as a result of positioning a locking unit, which prevents a drawer from being discharged from a cabinet, in a space between the drawer and a laundry storage space.

In addition, another object of the subject matter disclosed in this application is to provide a laundry treatment apparatus, which may include a first treatment device having a drawer, and a second treatment device separately provided on the first treatment device for treating laundry.

In addition, a further object of the subject matter disclosed in this application is to provide a laundry treatment apparatus, which may control a locking unit, which prevents a drawer from being unintentionally discharged from a cabinet, even if a control panel provided on a first treatment device is covered by a second treatment device.

BRIEF DESCRIPTION OF THE DRAWINGS

FIGS. 3(*a*) and 3(*b*) are views of example drawers being discharged from a cabinet.

FIGS. 5(*a*) and 5(*b*) are views of example drawers being fixed to a cabinet.

DETAILED DESCRIPTION

Figure 1:
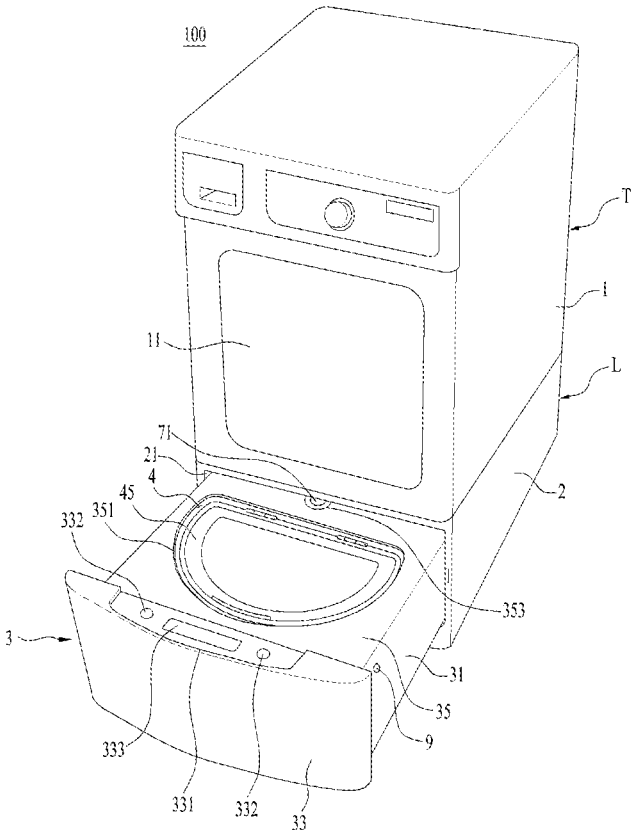
FIGS. 1, 2, and 6 are views of example laundry treatment apparatuses.

FIG. 1 illustrates an example laundry treatment apparatus. A laundry treatment apparatus 100 may include only a first treatment device L, or may include the first treatment device L and a second treatment device T as illustrated in FIG. 1. For convenience of description, the following description is based on the laundry treatment apparatus 100 including both the first treatment device L and the second treatment device T.

The first treatment device L is a device that implements a laundry treatment function, such as washing or drying of laundry (e.g. objects to be washed or objects to be dried), and the second treatment device T is a device that is separately coupled to the first treatment device L so as to implement a laundry treatment function.

Figure 2:
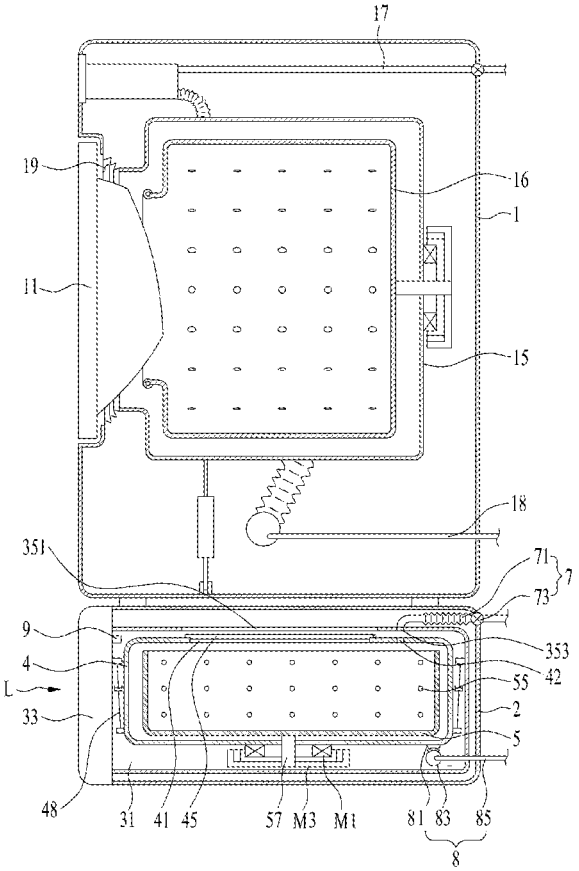

As illustrated in FIG. 2, the second treatment device T may include a second cabinet 1, which defines the external appearance of the second treatment device T, a second tub 15, which is provided inside the second cabinet 1 and is configured to store wash water therein, a second drum 16, which is rotatably provided inside the second tub 15 and provides a space in which laundry is stored, a second water supply unit 17, which supplies wash water into the second tub 15, and a second water drainage unit 18, which discharges the wash water stored in the second tub 15 to the outside of the second cabinet 1.

The second cabinet 1 includes a second treatment device opening 19 for the introduction and discharge of laundry, and the second treatment device opening 19 is opened or closed by a second treatment device door 11, which is rotatably coupled to the second cabinet 1.

The second treatment device opening 19 communicates with the interior of the second drum 16 through a second tub opening formed in the second tub 15 and a second drum opening formed in the second drum 16. Thus, the user may introduce laundry into the second drum 16 or may retrieve the laundry stored in the second drum 16 to the outside of the second cabinet 1 by opening the second treatment device door 11.

In some implementations, the second treatment device T is provided to additionally perform a laundry drying function, and a second hot air supply device needs to be provided inside the second cabinet 1 so as to supply heated air into the second tub 15.

The second hot air supply device may include a circulation duct configured to circulate air inside the second tub 15, and a heat exchanger provided inside the circulation duct so as to perform the dehumidification and heating of air discharged from the second tub 15.

In some implementations, the second hot air supply device may include a discharge duct configured to discharge air inside the second tub 15 to the outside of the second cabinet 1, a supply duct configured to supply air outside the second cabinet 1 to the second tub 15, and a heat exchanger provided inside the supply duct so as to perform the heating of air introduced into the supply duct.

Unlike the above description, assuming that the second treatment device T is provided to perform only the drying of laundry, the second tub 15 may be omitted in the second treatment device T. In some implementations, a device to rotatably support the second drum 16 needs to be provided inside the second treatment device T, and the second hot air supply device described above needs to be provided in order to supply hot air into the second drum 16.

As illustrated in FIG. 1, the first treatment device L includes a cabinet 2 configured to support the second cabinet 1, a drawer 3 configured to be discharged from the cabinet 2, and a laundry accommodation structure 4 and 5 provided within the drawer 3 so as to provide a laundry treatment space.

The cabinet 2 defines the external appearance of the first treatment device L. The cabinet 2 may be located above the second treatment device T, or may be located under the second treatment device T.

As illustrated in FIG. 1, in the case where the first treatment device L is located under the second treatment device T, because the height of the second treatment device door 11 is raised by the first treatment device L, it is expected to be convenient for the user to introduce or retrieve laundry into or from the second treatment device T. In addition, vibrations generated in the first treatment device L may be alleviated by the weight of the second treatment device T, and when the drawer 3 is discharged, there is no risk of the second treatment device T tilting toward the direction in which the drawer 3 is discharged.

The cabinet 2 has an entrance opening 21, and the drawer 3 may be discharged from the cabinet 2 or inserted into the cabinet 2 through the entrance opening 21. In some implementations, the entrance opening 21 may be formed in the direction in which the second treatment device door 11 is located (e.g. the front surface of the second treatment device T).

The drawer 3 includes a drawer body 31 having the open upper surface, and a drawer cover 35 provided in the open surface.

The drawer body 31 may take the form of an empty hexahedron having an inner space, and the drawer cover 35 is secured to the drawer body 31 so as to define the upper surface of the drawer body 31.

A drawer panel 33 is provided in the front surface of the drawer body 31. The drawer panel 33 is used to open or close the entrance opening 21 of the cabinet 2 and is also used to discharge or introduce the drawer body 31 from or into the cabinet 2. The drawer panel 33 is separably coupled to the drawer body 31.

The drawer panel 33 may be provided with a control panel 331, which controls the operation of the first treatment device L. The control panel 331 serves to allow the user to input a control command in order to control, for example, devices that supply or drain wash water into or from the laundry accommodation structure 4 and 5 (e.g. a water supply device and a water drainage device), a device that rotates laundry (e.g. a drum drive unit), and devices that supply steam or hot air to laundry (e.g. a hot air supply device and a moisture supply device).

In addition, the control panel 331 may include an input unit 332, which allows the user to input a control command to the first treatment device L, and a display unit 333, which notifies the user of a control command input via the input unit 332, or the progress of execution of a control command input by the user (e.g. a device in order to display information about the operation of the first treatment device L).

The drawer cover 35 may have a first aperture 351, which is formed in the drawer cover 35 so as to communicate the interior of the drawer body 31 with the outside of the drawer body 31, and a second aperture 353, which is formed in the drawer cover 35 so that a water supply pipe 71, which will be described below, is inserted into or secured to the second aperture 353.

As illustrated in FIG. 2, the laundry accommodation structure 4 and 5, provided within the drawer 3, may include a tub 4, which is provided inside the drawer body 31 and provides a space in which wash water is stored, and a drum 5, which is rotatably provided inside the tub 4 and is configured to store laundry therein.

The tub 4 is fixed inside the drawer 3 by a tub support member 48. The tub support member 48 serves to connect the tub 4 and the drawer 3 to each other so that the circumferential surface of the tub 4 may be supported by the drawer 3. The tub support member 48 may be provided with a device to alleviate vibrations.

The tub 4 includes an opening 41 formed in the upper surface thereof so as to communicate the interior of the tub 4 with the outside of the tub 4, and a door 45 configured to open or close the opening 41.

The door 45 is rotatably provided in the upper surface of the tub 4 (so as to open or close a portion of the upper surface of the tub 4). The door 45 may be moved away (rotated) from the drawer 3 through the first aperture 351 formed in the drawer cover 35. Thus, the user may pull the drawer 3 out of the cabinet 2, and thereafter open the door 45 so as to introduce laundry into the tub 4.

A water supply port 42 is formed in the upper surface of the tub 4 so that water is supplied into the tub 4 through the water supply port 42. The water supply port 42 may take the form of a hole that is formed in the upper surface of the tub 4 at a position below the second aperture 353, or may take the form of a pipe that connects the interior of the tub 4 and the second aperture 353 to each other.

The drum 5 may take the form of a cylinder having the open upper surface. The drum 5 may be rotated within the tub 4 by a drum drive unit, which is provided at the outside of the tub 4.

The drum drive unit may include a stator Ml, which is secured to the tub 4 and creates a rotation magnetic field, and a rotor M3, which is rotated by the rotation magnetic field. A drive shaft 57 is connected to the rotor M3 and penetrates the tub 4 so as to be secured to the bottom surface of the drum 3.

As illustrated in FIG. 2, the drive shaft 57 may be oriented orthogonal to the bottom surface of the drawer 3.

A plurality of drum through-holes 55 is formed in the circumferential surface of the drum 5 and communicates the interior of the drum 5 with the interior of the tub 4.

Because the laundry accommodation structure includes the tub 4 and the drum 5, the first treatment device L may perform a washing function. Thus, in order to allow the first treatment device L to additionally perform a laundry drying function, a hot air supply device may be provided inside the cabinet 2 so as to supply hot air into the tub 4.

The hot air supply device provided in the first treatment device L may be the same as the second hot air supply device described above, and thus a detailed description thereof is omitted.

Assuming that the first treatment device L is adapted to perform only the drying of laundry, the laundry accommodation structure may include only the drum 5, and the hot air supply device must be provided in the first treatment device L in order to supply hot air into the drum 5.

The first treatment device L is connected to a water source, which is located at the outside of the laundry treatment apparatus 100 via a water supply unit 7. The water supply unit 7 may include the water supply pipe 71, which connects the water source and the second aperture 353 to each other, and a valve 73 configured to open or close the water supply pipe 71 under the control of a controller.

The wash water, stored in the tub 4, is discharged to the outside of the cabinet 2 via a water drainage unit 8. The water drainage unit 8 may include a first water drainage pipe 83, which guides the wash water inside the tub 4 to the outside of the cabinet 2, a pump 81 (controlled by the controller), which is provided in the first water drainage pipe 83 so as to discharge the wash water from the tub 4, and a second water drainage pipe 85, which guides the water discharged from the pump 81 to the outside of the cabinet 2.

Because the drum drive unit is secured to the tub 4, and in turn, the tub 4 is secured to the drawer 3 via the tub support member 48, the first treatment device L having the above-described configuration is configured such that vibrations generated in the drum 5 or the tub 4 may be transmitted to the drawer 3 when the drum 5 is rotated by the drum drive unit.

When vibrations of the drum 5 or the tub 4 are transmitted to the drawer 3 during the operation of the drum drive unit, noises or vibrations due to the collision between the drawer 3 and the cabinet 2 may occur, and there is the possibility that the drawer 3 is unintentionally discharged from the cabinet 2 during the rotation of the drum drive unit.

To solve the problem described above, the laundry treatment apparatus 100 further includes a locking unit 9, which may prevent the drawer 3 from being unintentionally discharged from the cabinet 2 and may minimize vibrations of the drawer 3 within the cabinet 2.

The locking unit 9 includes a fastening mechanism 911 and 921, which is configured to reciprocate in any one direction among the height direction Y and the width direction X of the drawer 3 and to separably couple the drawer 3 to the cabinet 2, and a transfer member 95, which is configured to reciprocate in a remaining direction among the height direction Y and the width direction W of the drawer 3 and to operate the fastening mechanism 911 and 921.

Hereinafter, the case where the fastening mechanism 911 and 921 is provided to reciprocate in the width direction X of the drawer 3 and the transfer member 95 is provided to reciprocate in the height direction Y of the drawer 3 will first be described.

As illustrated in FIG. 3, the fastening mechanism may include a first fastening member and a second fastening member. The first fastening member may be a first bar 911 configured to be separably coupled to one side surface of the cabinet 2, and the second fastening member may be a second bar 913 configured to be separably coupled to an opposite side surface of the cabinet 2.

The first bar 911 is connected to the transfer member 95 via a first coupling portion 913. A free end F1 of the first bar 911 may be coupled to the first receiving piece 931 and 933 provided in the cabinet 2 or may be separated from the first receiving piece 931 and 933 based on the position of the transfer member 95.

The second bar 921 is connected to the transfer member 95 via a second coupling portion 923. A free end F2 of the second bar 921 may be coupled to a second receiving piece 941 and 943 provided in the cabinet 2 or may be separated from the second receiving piece 941 and 943 based on the position of the transfer member 95.

To this end, the first receiving piece may include a first receiving body 931 secured to the cabinet 2, and a receiving recess 933 formed in the first receiving body 931 so as to receive the free end F1 of the first bar 911, and the second receiving piece may include a second receiving body 941 secured to the cabinet 2 and a receiving recess 943 formed in the second receiving body 941 so as to receive the free end F2 of the second bar 921.

The reciprocation of the first bar 911 and the second bar 921 may be guided by a first guide provided in the drawer 3. That is, the first guide may include a first bar guide 361 provided in the drawer 3 so as to support the first bar 911, and a second bar guide 363 provided in the drawer 3 so as to support the second bar 921.

Figure 4A:
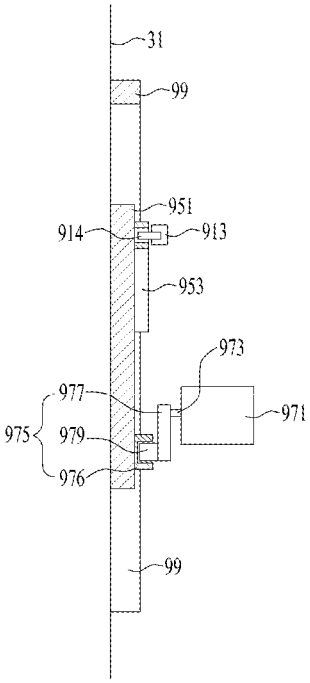
FIGS. 4(*a*), 4(*b*), and 9-12 are views of example locking units.
Figure 4B:
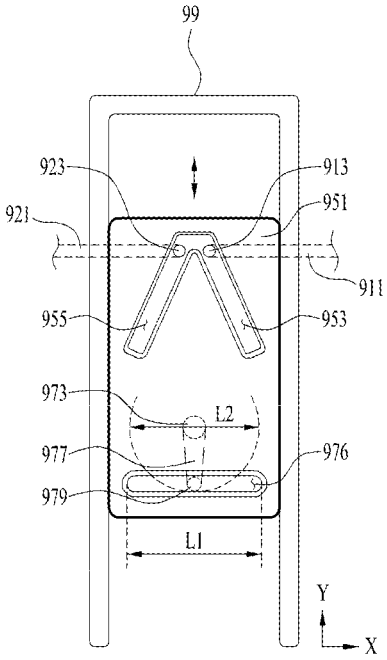

As illustrated in FIG. 4, the transfer member 95 may include a transfer body 951 configured to reciprocate in the height direction Y of the drawer 3, a first slot 953 formed in the transfer body 951 so that the first bar 911 is connected to the first slot 953, and a second slot 955 formed in the transfer body 951 so that the second bar 921 is connected to the second slot 955.

The drawer 3 may include a transfer member guide 99, which provides the movement path of the transfer body 951. FIG. 4 illustrates the case where the transfer member guide 99 is provided to support opposite side surfaces of the transfer body 951 by way of example.

The first slot 953 serves to push or pull the first coupling portion 913 provided at the first bar 911 (e.g. serves to move the first bar 911). The first coupling portion 913 provided at the first bar 911 may be inserted into the first slot 953 so as to be connected to the transfer body 951.

The first slot 953 may have a predetermined length in the height direction Y of the transfer body 951 and may be inclined relative to the height direction Y of the transfer body 951 by a prescribed angle.

This serves to allow the free end F1 of the first bar 911 to be separated from the first receiving body 931 when the first coupling portion 913 is located at the upper end of the first slot 953, and to allow the free end F1 of the first bar 911 to be coupled to the first receiving body 931 when the first coupling portion 913 is located at the lower end of the first slot 953.

The second slot 955 serves to push or pull the second coupling portion 923 provided at the second bar 921 (e.g. serves to move the second bar 921). The second coupling portion 923 provided at the second bar 921 may be inserted into the second slot 955 so as to be connected to the transfer body 951.

The second slot 955 may have a predetermined length in the height direction Y of the transfer body 951 (e.g. the predetermined direction in which the transfer body 951 reciprocates) and may be inclined relative to the height direction Y of the transfer body 951 by a prescribed angle.

In some implementations, the distance between the upper end of the first slot 953 and the upper end of the second slot 955 may be shorter than the distance between the lower end of the first slot 953 and the lower end of the second slot 955.

Accordingly, when the first coupling portion 913 and the second coupling portion 923 are located respectively at the upper ends of the first slot 953 and the second slot 955, the free end F1 of the first bar 911 and the free end F2 of the second bar 921 may be separated respectively from the first receiving body 931 and the second receiving body 941. When the first coupling portion 913 and the second coupling portion 923 are located respectively at the lower ends of the first slot 953 and the second slot 955, the free end F1 of the first bar 911 and the free end F2 of the second bar 921 may be coupled respectively to the first receiving body 931 and the second receiving body 941.

The transfer member 95 described above is adapted to reciprocate in the height direction Y of the drawer 3 by a drive unit 97 provided in the drawer 3. The drive unit 97 may include a motor 971 secured to the drawer 3 and a converter 975 configured to convert the rotation power of the motor 971 into the reciprocation power of the transfer body 951.

The converter 975 may include an arm 977 coupled to a rotating shaft 973 of the motor 971, a body slot 976 formed in the width direction X of the transfer body 951, and a slot connection portion 979 configured to connect the arm 977 and the body slot 976 to each other.

Because the arm 977 is rotated by the rotating shaft 973 of the motor 971 and the slot connection portion 979 protrudes from the arm 977, the slot connection portion 979 may be rotated along a circular path having a given diameter L2 when the motor 971 is operated.

The body slot 976 is formed in the direction X orthogonal to the direction Y in which the transfer body 951 moves, and has a length L1, which is equal to or greater than the diameter L2 of the circular path defined by the slot connection portion 979.

Accordingly, the rotation of the motor rotating shaft 973 is converted into the linear reciprocation of the transfer body 951 by the converter 975. As such, the transfer body 951 may reciprocate in the height direction Y of the drawer 3 under the guidance of the transfer member guide 99.

Hereinafter, the operational sequence of the locking unit 9 having the above-described configuration will be described with reference to FIGS. 3 to 5.

When the motor 971 is operated and the body slot 976 is located lower than the motor rotating shaft 973 (as in the state illustrated in FIG. 4 in which the first coupling portion 913 is located at the upper end of the first slot 953 and the second coupling portion 923 is located at the upper end of the second slot 955), the first bar 911 and the second bar 921 move toward the transfer body 951 respectively. Therefore, the free end F1 of the first bar 911 remains separated from the first receiving body 931 and the free end F2 of the second bar 921 remains separated from the second receiving body 941 (see FIG. 3).

When the free end F1 of the first bar 911 and the free end F2 of the second bar 921 are separated from the respective receiving bodies 931 and 941, the coupling of the drawer 3 and the cabinet 2 is released. Thereby, the user may discharge the drawer 3 from the cabinet 2, or may insert the drawer 3 into the cabinet 2.

When the motor rotating shaft 973 is rotated by the controller, the transfer body 951 moves upward in the height direction Y of the drawer 3 along the transfer member guide 99. When the body slot 976 is moved to the position higher than the rotating shaft 973 through the upward movement of the transfer body 951, the fastening mechanism 911 and 921 becomes the state illustrated in FIG. 5(*a*).

That is, when the body slot 976 is moved to the position higher than the rotating shaft 973, the free end F1 of the first bar 911 and the free end F2 of the second bar 921 move respectively away from the transfer body 951 (e.g., the first bar 911 and the second bar 921 move away from each other).

When the free ends F1 and F2 of the respective bars 911 and 921 move away from the transfer body 951, the free end F1 of the first bar 911 is coupled to the first receiving body 931 and the free end F2 of the second bar 921 is coupled to the second receiving body 941. Thereby, the drawer 3 is secured to the cabinet 2.

As described above, the first treatment device L is configured such that the opening 41 for the introduction of laundry is formed in the upper surface of the tub 4 and the drum drive unit provided to rotate the drum 5 is provided on the bottom surface of the tub 4.

That is, because the drive shaft 57, which rotates the drum 5, penetrates the bottom surface of the tub 4 and is connected to the bottom surface of the drum 5, the amplitude of vibration of the drum 5 (e.g. variation in the distance between the outer circumferential surface of the drum 5 and the inner circumferential surface of the tub 4), which is the major source of vibration of the first treatment device L, will increase from the bottom surface to the upper surface of the drum 5.

In consideration of the configuration of the first treatment device L in which the amplitude of vibration increases from the bottom surface to the upper surface of the drum 5, the first bar 911 and the second bar 921 of the locking unit 9 may be located higher than the drum drive unit (which may effectively prevent the drawer 3 from vibrating within the cabinet 2, or prevent the drawer 3 from being unintentionally discharged from the cabinet 2).

As illustrated in FIG. 2, because the tub support member 48 provided in the first treatment device L connects the outer circumferential surface of the tub 4 to the drawer 3, the tub 4 may vibrate in the plane parallel to the bottom surface of the drawer 3 when the drum 5 is rotated.

When the tub 4 vibrates in the plane parallel to the bottom surface of the drawer 3, force applied to any one side surface among the left side surface and the right side surface of the drawer 3 may be different from force applied to the other side surface, according to the form of vibrations.

However, because the fastening mechanism includes the first bar 911 configured to secure one side surface of the drawer 3 to the cabinet 2 and the second bar 921 configured to secure the opposite side surface of the drawer 3 to the cabinet 2, it is possible to effectively prevent the drawer 3 from being unintentionally discharged from the cabinet 2 when the tub 4 vibrates in the plane parallel to the bottom surface of the drawer 3.

In some implementations, in the locking unit 9, unlike the illustration of the drawings, the first bar 911 may be configured to reciprocate in the height direction Y of the drawer 3 and to connect the upper surface of the drawer 3 to the upper surface of the cabinet 2, and the second bar 921 may be configured to reciprocate in the height direction Y of the drawer 3 and to connect the lower surface of the drawer 3 to the lower surface of the cabinet 2. In some implementations, the transfer body 951 may be configured to reciprocate in the width direction X of the drawer 3.

In some implementations, the first bar 911 may be configured to reciprocate in the height direction Y of the drawer 3 and the second bar 921 may be configured to reciprocate in the width direction X of the drawer 3. In some implementations, the first bar 911 may be connected to the transfer body 951 through the first slot 953, and the second bar 921 may be secured to the upper end of the transfer body 951.

In some implementations, the fastening mechanism may further include a third bar configured to move along with the transfer body 951. In some implementations, the third bar may be configured to reciprocate in the height direction Y of the drawer 3 so as to separably couple the upper surface of the drawer 3 to the upper surface of the cabinet 2.

The locking unit 9 described above may be secured to the drawer body 31 so as to be exposed to the outside when the drawer panel 33 is separated from the drawer body 31.

As described above, because the drawer panel 33 serves to open or close the entrance opening 21 of the cabinet 2 and also serves to discharge the drawer body 31 from the cabinet 2, the drawer panel 33 is exposed to the outside of the cabinet 2 so as to define one surface of the cabinet 2 provided with the entrance opening 21.

Accordingly, when the drawer panel 33 is separated from the drawer body 31, the fastening mechanism 911 and 912, the transfer member 95, the drive unit 97, and the transfer member guide 99 are exposed to the outside of the cabinet 2, and therefore the repair or inspection of the locking unit 9 may be easy.

In addition, it may be more advantageous for the locking unit 9 described above to be located at the front end of the drawer body 31 than to be located at the rear end of the drawer body 31.

Most devices have an assembly tolerance, and the assembly tolerance increases as the configuration of the device is more complicated. In the case of the first treatment device L, a greater number of elements are coupled to the rear of the drawer body 31 than are coupled to the front of the drawer body 31.

That is, because the drawer panel 31 is provided at the front end of the drawer body 31, but the water supply unit 7 and the water drainage unit 8 need to be provided at the rear end of the drawer body 31, there is a high possibility of the sum of assembly tolerances of the respective elements assembled to the rear end of the drawer body 31 being greater than the sum of assembly tolerances of the elements provided at the front end of the drawer body 31.

An increase in the sum of assembly tolerances may problematically prevent the coupling of two elements that are configured to be selectively coupled to each other. Therefore, it may be more advantageous for the locking unit 9 to be located at the front end of the drawer body 31 than to be located at the rear end of the drawer body 31.

Figure 6:
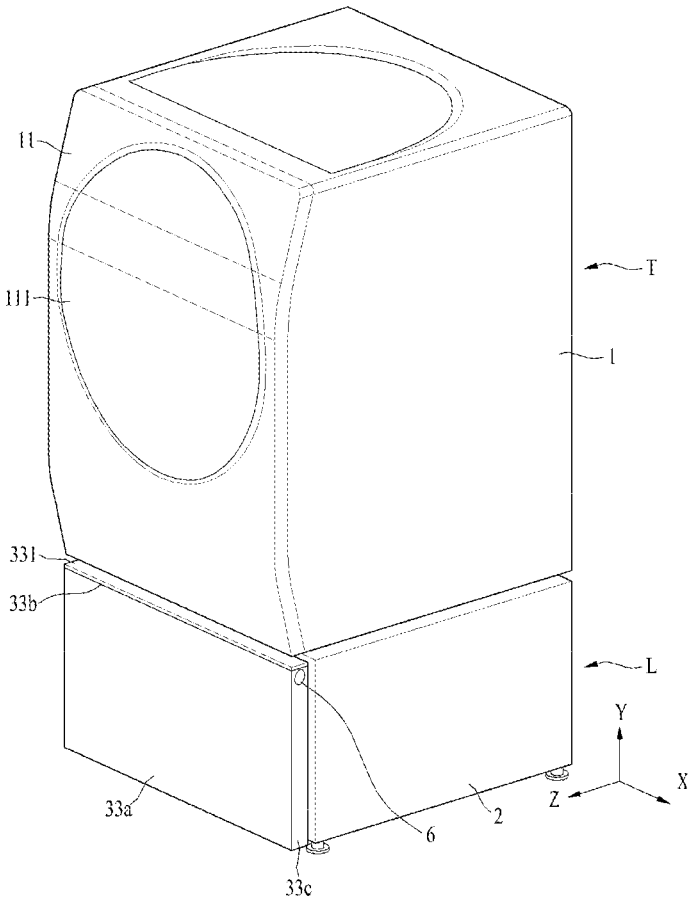

FIG. 6 illustrates an example laundry treatment apparatus. Likewise, the laundry treatment apparatus 100 may include only the first treatment device L, or may include both the first treatment device L and the second treatment device T located above the first treatment device L. For convenience of description, the following description is based on the laundry treatment apparatus 100 including both the first treatment device L and the second treatment device T.

The first treatment device L is a device that implements a laundry treatment function, such as washing or drying of laundry (e.g. objects to be washed or objects to be dried), and the second treatment device T is a device that is separately coupled to the first treatment device L so as to implement a laundry treatment function.

The second treatment device T may include the second cabinet 1, and a second laundry accommodation structure, which is provided inside the second cabinet 1 and provides a space for the washing or drying of laundry.

The second laundry accommodation structure may include a second tub, which is provided inside the second cabinet 1, and a second drum, which is rotatably provided inside the second tub and provides a space in which laundry is stored.

In some implementations, the second treatment device T may include a second water supply unit configured to supply water into the second tub, and a second water drainage unit configured to discharge the water stored in the second tub to the outside of the second cabinet 1.

The second cabinet 1 includes a second treatment device opening for the introduction and discharge of laundry, and the second treatment device opening is opened or closed by the second treatment device door 11, which is rotatably coupled to the second cabinet 1.

The second treatment device door 11 may include a window 111, which enables the user to view the interior of the second drum from the outside of the laundry treatment apparatus.

The second treatment device opening communicates with the interior of the second drum through a second tub opening formed in the second tub and a second drum opening formed in the second drum. Thus, the user may introduce laundry into the second drum or may retrieve the laundry stored in the second drum to the outside of the second cabinet 1 by opening the second treatment device door 11.

In some implementations, the second treatment device T is provided to additionally perform a laundry drying function, and a second hot air supply device needs to be provided inside the second cabinet 1 so as to supply heated air into the second tub.

The second hot air supply device may include a circulation duct configured to circulate air inside the second tub, and a heat exchanger provided inside the circulation duct so as to perform the dehumidification and heating of air discharged from the second tub.

In some implementations, the second hot air supply device may include a discharge duct configured to discharge air inside the second tub to the outside of the second cabinet 1, a supply duct configured to supply air outside the second cabinet 1 to the second tub, and a heat exchanger provided inside the supply duct so as to perform the heating of air introduced into the supply duct.

Unlike the above description, assuming that the second treatment device T is provided to perform only the drying of laundry, the second tub may be omitted in the second treatment device T. In some implementations, a device to rotatably support the second drum needs to be provided inside the second treatment device T, and the second hot air supply device described above needs to be provided in order to supply hot air into the second drum.

Figure 7:
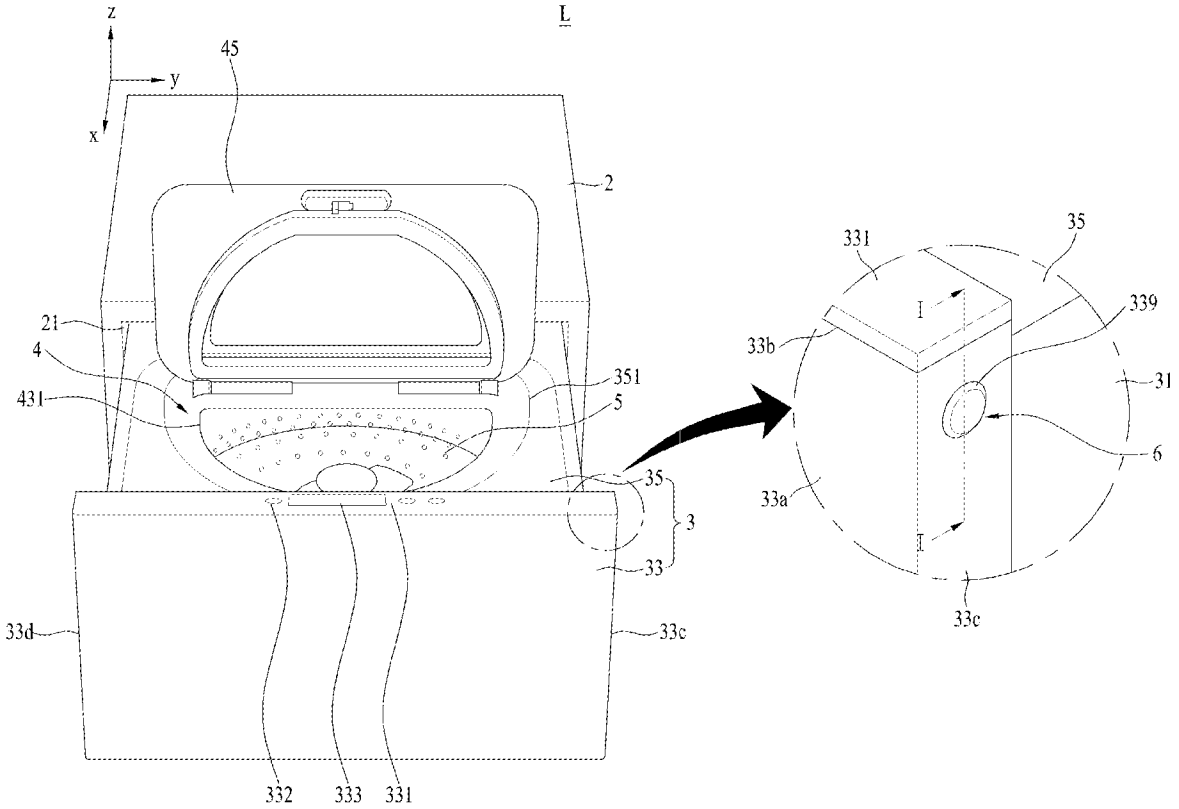
FIGS. 7 and 8 are views of example first treatment devices.

As illustrated in FIG. 7, the first treatment device L includes the cabinet 2, the drawer 3 configured to be discharged from the cabinet 2, and the laundry accommodation structure 4 and 5 provided inside the drawer 3 so as to provide a laundry treatment space.

The cabinet 2 has the entrance opening 21, and the drawer 3 may be discharged from the cabinet 2 or inserted into the cabinet 2 through the entrance opening 21. The cabinet 2 may have a longer length in the width direction (X-axis) than in the height direction (Y-axis) thereof (e.g., the length of the drawer 3 in the width direction may be greater than the length of the drawer 3 in the height direction).

A slider 23 (see FIG. 9) configured to support the drawer 3 is provided inside the cabinet 2. The slider 23 may include a housing 231 secured inside the cabinet 2, and a slider body 233 secured to the drawer 3 so as to be inserted into the housing 231.

The drawer 3 includes the drawer body (31, see FIG. 8) and the drawer cover 35, which defines the upper surface of the drawer body 31. The drawer body 31 may take the form of a hexahedron having the open upper surface, and the drawer cover 35 may be provided to close the upper surface of the drawer body 31.

As illustrated in FIG. 7, the drawer panel 33 is provided in the front surface of the drawer body 31. The drawer panel 33 may be used to open or close the entrance opening 21 of the cabinet 2 and may also be used to pull or push the drawer body 31 from or into the cabinet 2.

The drawer panel 33 may include a panel front surface 33*a*, which is parallel to the front surface of the cabinet 2 (e.g. the surface in which the entrance opening 21 is formed), a first side surface 33*c* and a second side surface 33*d*, which extend from opposite sides of the panel front surface 33*a* toward the drawer body 31, and a panel upper surface 33*b*, which extends from the upper end of the panel front surface 33*a* toward the drawer body 31 so as to define the upper surface of the drawer panel 33.

The panel upper surface 33*b* may be provided with the control panel 331, which controls the operation of the first treatment device L. The control panel 331 serves to allow the user to input a control command in order to control, for example, devices that supply or drain wash water into or from the laundry accommodation structure 4 and 5 (e.g. a water supply device and a water drainage device), a device that rotates laundry (e.g. a drum drive unit), and devices that supply steam or hot air to laundry (e.g. a hot air supply device and a moisture supply device).

In addition, the control panel 331 may include the input unit 332, which allows the user to input a control command to the first treatment device L, and the display unit 333, which notifies the user of a control command input via the input unit 332 or the progress of execution of a control command input by the user (e.g. a device to display information about the operation of the first treatment device L). The control panel 331 described above may be provided on the panel upper surface 33*b*.

Figure 8:
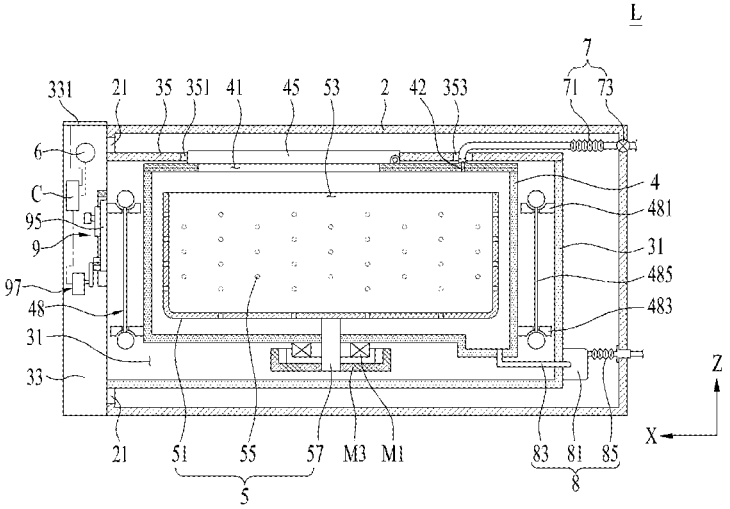

As illustrated in FIG. 8, the drawer cover 35 may have the first aperture 351, which is formed in the drawer cover 35 so as to communicate the interior of the drawer body 31 with the outside of the drawer body 31, and the second aperture 353, which is formed in the drawer cover 35 so that the water supply pipe 71, which will be described below, is inserted into or secured to the second aperture 353.

The laundry accommodation structure 4 and 5, provided within the drawer 3, may include the tub 4, which is provided inside the drawer body 31 and provides a space in which wash water is stored, and the drum 5, which is rotatably provided inside the tub 4 and is configured to store laundry therein.

The tub 4 is movably coupled inside the drawer 3 by the tub support member 48. The tub support member 48 serves to connect the outer circumferential surface of the tub 4 and the drawer 3 to each other. The tub support member 48 may include a first bracket 481 provided on the drawer 3, a second bracket 483 provided on the outer circumferential surface of the tub 4, and a support bar 485 configured to connect the first bracket 481 and the second bracket 483 to each other.

The tub 4 has the opening 41 formed in the upper surface thereof so as to communicate the interior of the tub 4 with the outside of the tub 4, the water supply port 42 for the supply of water into the tub 4, and the door 45 configured to open or close the opening 41.

The door 45 is rotatably provided in the upper surface of the tub 4 (so as to open or close a portion of the upper surface of the tub 4). The door 45 may be rotated without interference with the drawer cover 35 through the first aperture 351. Thus, the user may pull the drawer 3 out of the cabinet 2, and thereafter open the door 45 so as to introduce laundry into the tub 4.

The drum 5 includes a drum body 51, which has a cylindrical shape and is located inside the tub 4, and a drum opening 53, which is formed in the upper surface of the drum body 51. The drum through-holes 55 may be formed in the circumferential surface and the bottom surface of the drum body 51, and the drive shaft 57 is provided on the lower surface of the drum body 51.

The drum body 51 may be rotated within the tub 4 by a drum drive unit, which is provided at the outside of the tub 4. The drum drive unit may include the stator Ml, which is secured to the tub 4 and creates a rotation magnetic field, and the rotor M3, which is rotated by the rotation magnetic field. The drive shaft 57 penetrates the bottom surface of the tub 4 and is connected to the rotor M3.

As illustrated in FIG. 8, the drive shaft 57 may be oriented orthogonal to the opening 41 (e.g. orthogonal to the lower surface of the drawer body 31).

Because the laundry accommodation structure includes the tub 4 and the drum 5, the first treatment device L may perform a washing function. Thus, in order to allow the first treatment device L to additionally perform a laundry drying function, a hot air supply device may be provided inside the cabinet 2 so as to supply hot air into the tub 4.

The first treatment device L is connected to a water source, which is located at the outside of the cabinet 2 via the water supply unit 7. The water supply unit 7 may include the water supply pipe 71, which connects the water source and the water supply port 42 to each other, and the valve 73 configured to open or close the water supply pipe 71 under the control of a controller C.

The wash water, stored in the tub 4, is discharged to the outside of the cabinet 2 via the water drainage unit 8. The water drainage unit 8 may include the first water drainage pipe 83, which guides the wash water inside the tub 4 to the outside of the cabinet 2, the pump 81 (controlled by the controller), which is provided to discharge the wash water from the tub 4 to the first water drainage pipe 83, and the second drainage pipe 85, which guides the water discharged from the pump 81 to the outside of the cabinet 2.

Because the drum drive unit is secured to the tub 4, and in turn, the tub 4 is secured to the drawer 3 via the tub support member 48, the first treatment device L having the above-described configuration is configured such that vibrations generated in the drum 5 or the tub 4 may be transmitted to the drawer 3 when the rotator M3 is rotated.

When vibrations of the drum 5 or the tub 4 are transmitted to the drawer 3, noises or vibrations due to the collision between the drawer 3 and the cabinet 2 may occur, and there is the possibility that the drawer 3 is unintentionally discharged from the cabinet 2 during the rotation of the drum drive unit.

To solve the problem described above, the laundry treatment apparatus may further include the locking unit 9, which may prevent the drawer 3 from being unintentionally discharged from the cabinet 2 and may minimize vibrations of the drawer 3 within the cabinet 2.

Figure 9:
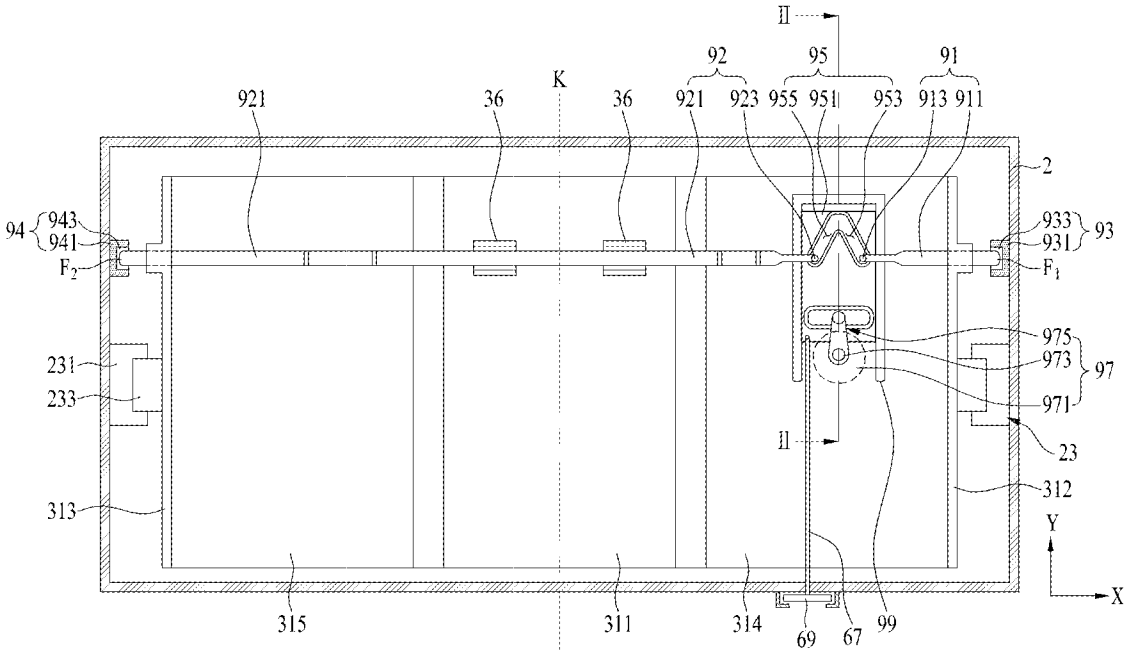

As illustrated in FIG. 9, the locking unit 9 includes a fastening mechanism 91 and 92, which is configured to reciprocate in the width direction (X-axis) of the drawer 3 and is separably secured to the cabinet 2, the transfer member 95, which is configured to operate the fastening mechanism 91 and 92, and the drive unit 97, which serves to reciprocate the transfer member 95 in the height direction (Y-axis) of the drawer 3.

The fastening mechanism may include a first fastening member 91, which is provided in the width direction of the drawer 3 and is separably coupled to one side surface of the cabinet 2, and a second fastening member 92, which is provided in the width direction of the drawer 3 and is separably coupled to an opposite side surface of the cabinet 2.

The first fastening member 91 may be the first bar 911 configured to reciprocate in the width direction of the drawer 3, and the second fastening member 92 may be the second bar 921 configured to reciprocate in the width direction of the drawer 3.

The first bar 911 is connected to the transfer member 95 via the first coupling portion 913. The free end F1 of the first bar 911 may be coupled to or separated from a first receiving piece 93 provided in the cabinet 2 based on the position of the transfer member 95.

Likewise, the second bar 921 is connected to the transfer member 95 via the second coupling portion 923. The free end F2 of the second bar 921 may be coupled to or separated from a second receiving piece 94 provided in the cabinet 2 based on the position of the transfer member 95.

The first receiving piece 93 may include the first receiving body 931 secured inside the cabinet 2, and the receiving recess 933 formed in the first receiving body 931 so as to receive the free end F1 of the first bar 911, and the second receiving piece 94 may include the second receiving body 941 secured inside the cabinet 2, and the receiving recess 943 formed in the second receiving body 941 so as to receive the free end F2 of the second bar 921.

Figure 11:
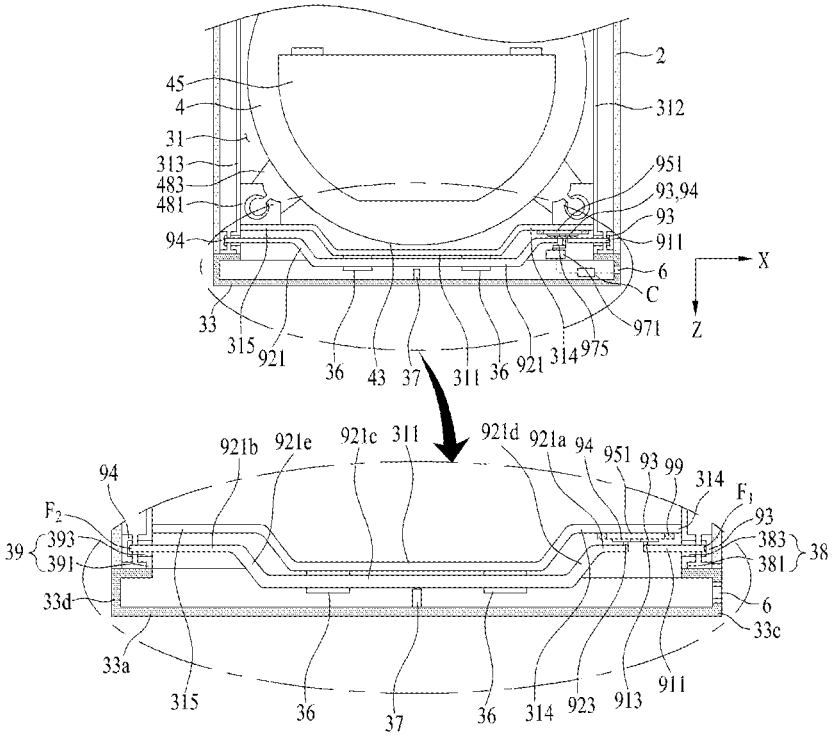

However, the first receiving piece 93 and the second receiving piece 94 must be provided inside the cabinet 2 at positions inwardly spaced apart from the entrance opening 21 by a prescribed distance (see FIG. 11).

Because the locking unit 9 is provided inside the drawer panel 33 configured to open or close the entrance opening 21, the receiving pieces 93 and 94 need to be located inside the cabinet 2 at positions inwardly spaced apart from the entrance opening 21. This is because the drawer body 31 will be secured to the cabinet 2 when the first fastening member 91 and the second fastening member 92 are inserted respectively into the first receiving piece 93 and the second receiving piece 94.

Figure 10:
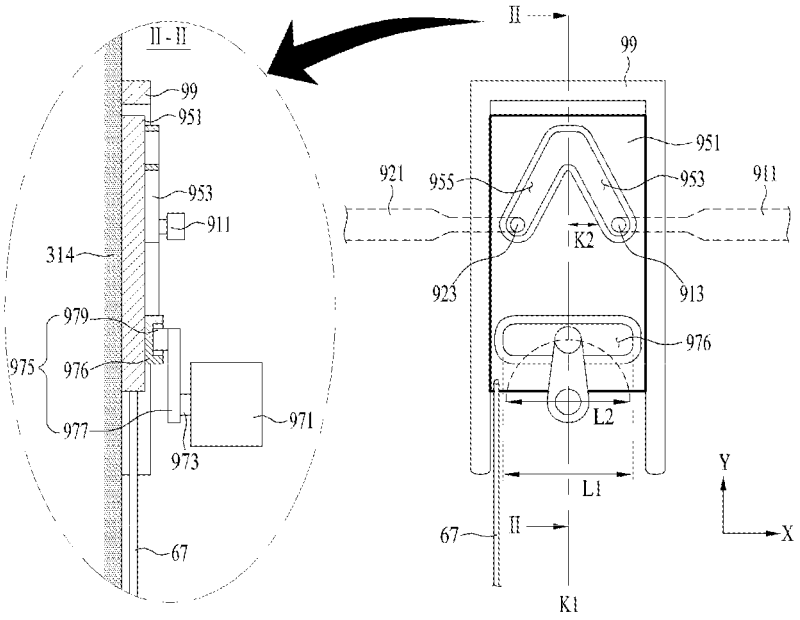

As illustrated in FIG. 10, the transfer member 95 may include the transfer body 951 configured to reciprocate in the height direction Y of the drawer body 31, the first slot 953 formed in the transfer body 951 so that the first fastening member 91 is connected to the first slot 953, and the second slot 955 formed in the transfer body 951 so that the second fastening member 92 is connected to the second slot 955.

The drawer body 31 may be provided with the transfer member guide 99, which provides the movement path of the transfer body 951. FIG. 10 illustrates the case where the transfer member guide 99 is provided to support opposite side surfaces of the transfer body 951 by way of example.

The first slot 953 serves to push or pull the first coupling portion 913 provided at the first bar 911 (e.g. serves to move the first bar 911). The first coupling portion 913 provided at the first bar 911 may be inserted into the first slot 953 so as to be connected to the transfer body 951.

The first slot 953 may have a predetermined length in the movement direction of the transfer body 951 (e.g. in the height direction Y of the transfer body 951) and may be inclined relative to the straight line, which passes the center of the transfer body 951 and is parallel to the movement direction of the transfer body 951 (e.g. the reference line, K1), by a prescribed angle.

That is, the first slot 953 may be inclined relative to the reference line K1 by an angle K2 within a range from 0 degrees to 90 degrees. This serves to move the first bar 911 by varying the position of the transfer body 951.

The second slot 955 serves to push or pull the second coupling portion 923 provided at the second bar 921 (e.g. serves to move the second bar 921). The second bar 921 is connected to the transfer body 951 as the second coupling portion 923 is inserted into the second slot 955.

The second slot 955 may have a predetermined length in the movement direction of the transfer body 951, and may be inclined relative to the reference line K1 by a prescribed angle.

Assuming that the direction, in which the transfer body 951 moves so that the distance between the first coupling portion 913 and the second coupling portion 923 is increased, is set to a first direction and the direction, in which the transfer body 951 moves so that the distance between the first coupling portion 913 and the second coupling portion 923 is reduced, is set to a second direction, the first slot 953 and the second slot 955 described above will couple the free end F1 of the first bar 911 and the free end F2 of the second bar 921 to the respective receiving pieces 93 and 94 when the transfer body 951 moves in the first direction, and will separate the free end F1 of the first bar 911 and the free end F2 of the second bar 921 from the respective receiving pieces 93 and 94 when the transfer body 951 moves in the second direction.

That is, when the first coupling portion 913 and the second coupling portion 923 are located at the lower ends of the respective slots 953 and 955 (e.g. positions at which the distance between the slots 953 and 955 is the maximum or positions at which the distance between the first coupling portion 913 and the second coupling portion 923 is the maximum), the free ends F1 and F2 of the respective bars 911 and 921 will be coupled to the first receiving body 931 and the second receiving body 935 respectively.

In some implementations, when the first coupling portion 913 and the second coupling portion 923 are located at the upper ends of the first slot 953 and the second slot 955 (e.g. positions at which the distance between the slots 953 and 955 is the minimum or positions at which the distance between the first coupling portion 913 and the second coupling portion 923 is the minimum), the free end F1 of the first bar 911 and the free end F2 of the second bar 921 will be separated from the first receiving body 931 and the second receiving body 935 respectively.

The transfer member 95 described above may reciprocate in the height direction Y of the drawer 3 via the drive unit 97. The drive unit 97 may include the motor (971, see FIG. 9) and the converter 975, which converts the rotation of the motor 971 into the reciprocation of the transfer body 951.

As illustrated in FIG. 10, the converter 975 may include the body slot 976 formed in the width direction X of the transfer body 951, the arm 977 coupled to the motor rotating shaft 973, and the slot connection portion 979 configured to connect the arm 977 and the body slot 976 to each other.

Because the arm 977 is rotated by the rotating shaft 973 of the motor 971 and the slot connection portion 979 protrudes from the arm 977, the slot connection portion 979 may be rotated along the circular path having the given diameter L2 when the motor 971 is operated.

The body slot 976 is formed in the direction X orthogonal to the direction Y in which the transfer body 951 moves, and has a length L1, which is equal to or greater than the diameter L2 of the circular path defined by the slot connection portion 979.

Accordingly, the rotation of the motor rotating shaft 973 is converted into the linear reciprocation of the transfer body 951 by the converter 975. As such, the transfer body 951 may reciprocate in the height direction Y of the drawer 3 under the guidance of the transfer member guide 99.

As illustrated in FIG. 11, the locking unit 9 described above may be provided at a position spaced apart from the center (K, FIG. 9) of the drawer panel 33 in the interior space of the drawer panel 33. That is, the locking unit 9 may be provided on one side surface of the drawer panel 33.

In the case where the cross section of the tub 4, which is parallel to the bottom surface of the drawer body 31, has a circular shape, there is a space between the corner of the front surface of the drawer body 31 (e.g. the position at which the front surface of the drawer body 31 and the side surface of the drawer body 31 meet each other) and a circumferential surface 43 of the tub 4. Accordingly, when the locking unit 9 is provided in the space between the corner of the drawer body 31 and the tub circumferential surface 43, the thickness of the drawer panel 33 (e.g. the thickness of the drawer panel 33 in the Z-axis) may be minimized, which may consequently minimize the volume of the entire first treatment device L.

To this end, the front surface of the drawer body 31 may include a first surface 311, which is provided in the direction in which the entrance opening 21 is located, and a second surface 312 and a third surface 313, which extend from opposite ends of the first surface 311 toward the interior of the cabinet 2. In some implementations, the second surface 312 and the third surface 313 may be surfaces extending from the bottom surface of the drawer body 31 toward the drawer cover 35 (e.g. the side surfaces of the drawer body 31).

The first surface 311 is provided with a first bent portion 314 and a second bent portion 315. The first bent portion 314 protrudes from the first surface 311 toward a space between the second surface 312 and the circumferential surface 43 of the tub 4. The second bent portion 315 protrudes from the first surface 311 toward a space between the third surface 313 and the circumferential surface 43 of the tub 4.

In some implementations, the locking unit 9 may be provided on any one of the first bent portion 314 and the second bent portion 315. FIG. 11 illustrates the case where the locking unit 9 is provided on the first bent portion 314 by way of example.

In the case where the locking unit 9 is provided on the first bent portion 314, the transfer body 951 must be provided on the first bent portion 314 so as to reciprocate in the height direction (Y-axis) of the drawer body 31, and the transfer member guide 99 must be provided on the first bent portion 314 so as to guide the movement of the transfer body 951. In addition, the length of the first bar 911 will be smaller than the length of the second bar 921.

In addition, the first bar free end F1 provided at the first fastening member 91 must be separably coupled to the inner circumferential surface of the cabinet 2, which is parallel to the second surface 312. The second bar free end F2 provided at the second fastening member 92 must be separably coupled to the inner circumferential surface of the cabinet 2, which is parallel to the third surface 313.

That is, the first receiving piece 93 must be secured to the inner circumferential surface of the cabinet 2, which is parallel to the second surface 312, and the second receiving piece 94 must be secured to the inner circumferential surface of the cabinet 2, which is parallel to the third surface 313.

In addition, the second bar 921 must include a bar body 921*a*, which is disposed on the first bent portion 314 and includes the second coupling portion 923, a separable coupling bar portion 921*b*, which is disposed on the second bent portion 315 and includes the second bar free end F2, a connection body 921*c*, which is provided in the width direction (X-axis) of the first surface 311, a first inclined portion 921*d*, which connects the bar body 921*a* and the connection body 921*c* to each other and is inclined toward the first bent portion 314, and a second inclined portion 921*e*, which connects the separable coupling bar portion 921*b* and the connection body 921*c* to each other and is inclined toward the second bent portion 315. In some implementations, the second inclined portion 921*e* may be provided so as to allow the second bar free end F2 to be located in the extension line of the first bar 911.

The drawer body 31 may include a first guide 36 (e.g. a second bar guide) configured to guide the movement of the second bar 921. The first guide 36 may protrude from the first surface 311 so as to support only the lower surface of the second bar 921, or so as to support both the upper surface and the lower surface of the second bar 921.

The drawer panel 33 may further include a second guide 37 configured to maintain the distance between the second bar 921 and the first surface 311.

As described above, the drawer panel 33 may include the panel front surface 33*a*, which is parallel to the front surface of the cabinet 2 and is spaced apart from the first surface 311 by a prescribed distance, and the first side surface 33*c* and the second side surface 33*d*, which are located at opposite side surfaces of the panel front surface 33*a* so as to secure the panel front surface 33*a* to the drawer body 31. The second guide 37 may protrude from the panel front surface 33*a* to the first surface 311 of the drawer body 31.

In addition, the drawer body 31 may further include a third guide 38 configured to support the first bar free end F1 and a fourth guide 39 configured to support the second bar free end F2.

The third guide 38 may include a third guide body 381, which extends from the second surface 312 of the drawer body 31 toward the drawer panel 33, and a third guide body through-hole 383, which is formed in the third guide body 381 so that the first bar free end F1 is inserted into the third guide body through-hole 383.

Likewise, the fourth guide 39 may include a fourth guide body 391, which extends from the third surface 313 of the drawer body 31 toward the drawer panel 33, and a fourth guide body through-hole 393, which is formed in the fourth guide body 391 so that the second bar free end F2 is inserted into the fourth guide body through-hole 393.

Although the implementations has been described above based on the case where the cross section of the tub 4, which is parallel to the bottom surface of the drawer body 31, has a circular shape, the above-described features are not limited to only the case where the cross section of the tub 4, which is parallel to the bottom surface of the drawer body 31, has a circular shape.

In some implementations, the above description may also be applied to the case where a portion of the outer circumferential surface of the tub 4 is formed into a curved surface facing the first surface 311, the second surface 312, and the third surface 313 of the drawer body 31.

Hereinafter, the operational sequence of the locking unit 9 having the above-described configuration will be described.

Figure 12:
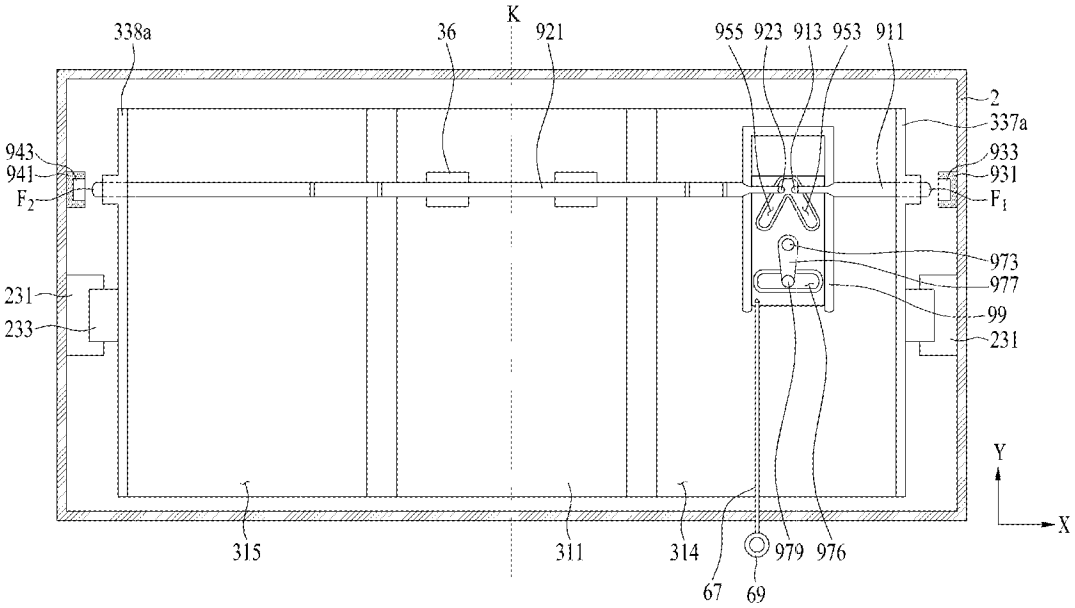

In FIG. 12, when the body slot 976 is located lower than the rotating shaft 973 of the motor 971 (e.g. the state in which the first coupling portion 913 is located at the upper end of the first slot 953 and the second coupling portion 923 is located at the upper end of the second slot 955), the free end F1 of the first bar 911 remains separated from the first receiving piece 93 and the free end F2 of the second bar 921 remains separated from the second receiving piece 94. As such, the user may discharge the drawer 3 from the cabinet 2.

In the state in which the drawer 3 is discharged from the cabinet 2, the user may introduce laundry into the drum body 51 through the first aperture 351, the opening 41, and the drum opening 53.

When the laundry is completely introduced into the drum 5, the user commands (inputs a control command for) the operation of the first treatment device L via the input unit 332 of the control panel 331 after pushing the drawer 3 into the cabinet 2.

As illustrated in FIG. 8, when the control command is input via the input unit 332, the controller C operates the motor 971 so as to rotate the rotating shaft 973.

As illustrated in FIG. 9, when the rotating shaft 973 of the motor 971 is rotated by the controller C, the transfer body 951 moves toward the upper end of the drawer 3 on the transfer member guide 99. When the body slot 976 moves to the position higher than the rotating shaft 973 via the upward movement of the transfer body 951, the first fastening member 91 and the second fastening member 92 reach the state illustrated in FIG. 11.

That is, when the body slot 976 moves to the position higher than the rotating shaft 973, the free end F1 of the first bar 911 and the free end F2 of the second bar 921 move away from the transfer body 951 respectively (e.g., the first bar 921 and the second bar 921 move away from each other).

When the free ends F1 and F2 of the respective bars 911 and 921 move away from the transfer body 951, the drawer body 31 is secured to the cabinet 2 because the free end F1 of the first bar 911 is coupled to the first receiving piece 93 and the free end F2 of the second bar 921 is coupled to the second receiving piece 94. In some implementations, the drawer 3 is prevented from being discharged from the cabinet 2 while the drum 5 is rotated.

When the execution of the control command input via the control panel 331 is completed, the controller C rotates the rotating shaft 973 of the motor 971 so as to move the body slot 976 to the position lower than the rotating shaft 973 of the motor 971.

As illustrated in FIG. 12, when the body slot 976 moves to the position lower than the rotating shaft 973 of the motor 971, the user may discharge the drawer 3 from the cabinet 2 because the free end F1 of the first bar 911 is separated from the first receiving piece 93 and the free end F2 of the second bar 921 is separated from the second receiving piece 94.

Although the locking unit 9 having the above-described configuration may prevent the drawer 3 from being discharged from the cabinet 2 during the rotation of the drum 5, it may be difficult to release the drawer 3 secured to the cabinet 2 when it may be necessary to discharge the drawer 3 during the rotation of the drum 5 (e.g. during the operation of the first treatment device L before the execution of the control command input to the first treatment device is completed).

The case where it may be necessary to discharge the drawer 3 during the rotation of the drum 5 may be, for example, the case where it may be necessary to additionally supply laundry into the drum 5 or the case where the first treatment device L fails to complete the input control command due to some reasons.

In order to solve the problem described above, the laundry treatment apparatus may further include an unlocking unit 6, which controls the locking unit 9 so as to enable the drawer 3 to be discharged from the cabinet 2.

Figure 13:
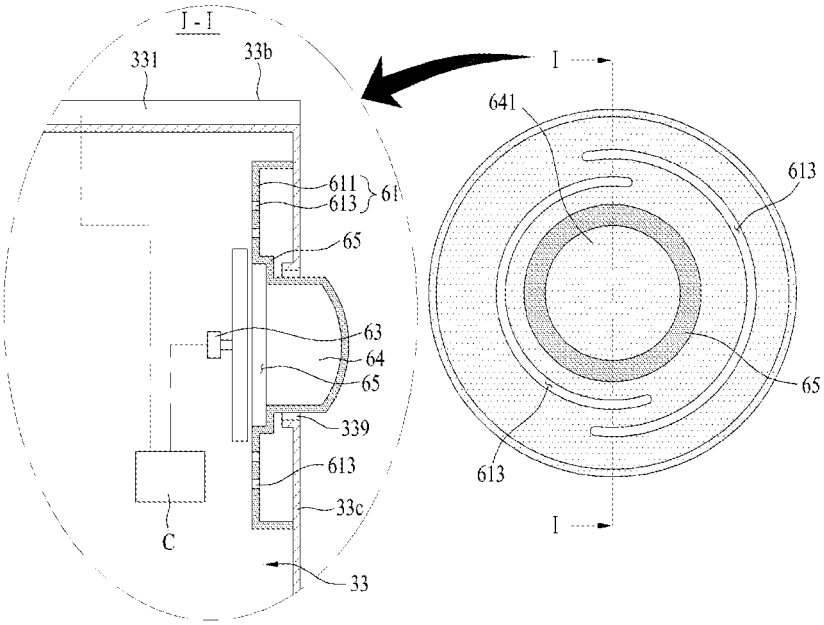
FIG. 13 is a view of an example unlocking unit.

As illustrated in FIG. 13, the unlocking unit 6 may be provided on any one of the first side surface 33*c* and the second side surface 33*d* among the surfaces 33*a*, 33*b*, 33*c* and 33*d* of the drawer panel 33.

Although the unlocking unit 6 may be provided on the panel upper surface 33*b* on which the control panel 331 is provided, when the second treatment device T is seated on the upper surface of the first treatment device L, the user may be difficult to access the unlocking unit 6. This is because the second treatment device T may prevent the panel upper surface 33*b* from being exposed to the outside when the second treatment device T is seated on the upper surface of the cabinet 2 of the first treatment device L (see FIG. 6). Thus, it is not desirable to locate the unlocking unit 6 on the panel upper surface 33*b*.

Although the unlocking unit 6 may be provided on the panel front surface 33*a* to which the user is always accessible, this may disadvantageously deteriorate the aesthetic appearance of the laundry treatment apparatus.

As illustrated in FIG. 13, the unlocking unit 6 may include a support portion 61 secured inside the drawer panel 33, a pressure portion 64 configured to protrude from the support portion 61 so as to be inserted into a panel through-hole 339 formed in any one of the first side surface and the second side surface, and a signal generator 63 configured to generate and transmit a control signal to the controller C when the pressure portion 64 is pushed into the drawer panel 33.

The support portion 61 may include a support body 611 secured to the drawer panel 33, and an elasticity provider 613 formed in the support body 611 so as to provide the pressure portion 64 with elasticity.

The elasticity provider 613 may take the form of a "C"-shaped slit formed in the support body 611. In some implementations, the elasticity provider 613 may be configured to surround a portion of the outer circumferential surface of the pressure portion 64.

In the unlocking unit 6 having the above-described configuration, when the user pushes the pressure portion 64 into the drawer panel 33, the signal generator 63 generates a control signal and transmits the same to the controller C. The controller C may control the motor 971 so that the first fastening member 91 and the second fastening member 92 are separated from the respective receiving pieces 93 and 94.

Because the signal generator 63 may be damaged when water is introduced into the drawer panel 33 through the panel through-hole 339, an expanded portion 65 may be provided between the panel through-hole 339 and the signal generator 63. The expanded portion 65 connects the support body 611 and the pressure portion 64 to each other and has a greater diameter than the panel through-hole 339.

When the expanded portion 65 is provided between the panel through-hole 339 and the signal generator 63, even if water is introduced through the panel through-hole 339, it is possible to prevent the water from moving to the signal generator 63.

Although the unlocking unit 6 has been described above based on the case where the control signal generated by the signal generator 63 is transmitted to the motor 971 via the controller C, the signal generator 63 may be provided so as to directly transmit the control signal to the motor 971.

However, when the unlocking unit 6 described above is damaged, it may be difficult to separate the drawer 3 from the cabinet 2 by releasing the locking unit 9. To solve the problem described above, the laundry treatment apparatus may further include a wire 67, which moves the transfer body 951 so as to allow the fastening members 91 and 92 to move away from the respective receiving pieces 93 and 94.

As illustrated in FIG. 12, one end of the wire 67 may be secured to the transfer body 951, and a free end of the wire 67 may be exposed to the outside of the drawer panel 33. In some implementations, a handle 69 may be provided on the free end of the wire 67.

Accordingly, as illustrated in FIG. 9, when the unlocking unit 6 breaks down in the state in which the drawer 3 is secured to the cabinet 2, the user may move the transfer body 951 toward the lower side of the drawer panel 33 (e.g. toward the bottom surface of the drawer 3) by pulling the handle 69. Thereby, because the transfer body 951 moves as illustrated in FIG. 12, the first fastening member 91 may be separated from the first receiving piece 93 and the second fastening member 92 may be separated from the second receiving piece 94. In some implementations, the coupling of the drawer 3 and the cabinet 2 may be released even when the unlocking unit 6 breaks down.

As is apparent from the above description, the subject matter described in this application has the effects as follows.

The subject matter described in this application has the effect of providing a laundry treatment apparatus, which may perform washing or drying of laundry using a drawer that may be discharged from a cabinet.

In addition, the subject matter described in this application has the effect of providing a laundry treatment apparatus, which may minimize vibration of a drawer within a cabinet while laundry is washed or dried.

In addition, the subject matter described in this application has the effect of providing a laundry treatment apparatus, which may prevent a drawer from being discharged from a cabinet while laundry is washed or dried.

In addition, the subject matter described in this application has the effect of providing a laundry treatment apparatus, which may have a minimum volume as a result of positioning a locking unit, which prevents a drawer from being discharged from a cabinet, in a space between the drawer and a laundry storage space.

In addition, the subject matter described in this application has the effect of providing a laundry treatment apparatus, which may include a first treatment device having a drawer, and a second treatment device separately provided on the first treatment device for treating laundry.

In addition, the subject matter described in this application has the effect of providing a laundry treatment apparatus, which may control a locking unit, which prevents a drawer from being unintentionally discharged from a cabinet, even if a control panel provided on a first treatment device is covered by a second treatment device.

What is claimed is:

1. A laundry treatment apparatus comprising:

a cabinet that has an entrance opening;

a drawer body that includes a first surface that is parallel to the entrance opening, a second surface that extends from a first end of the first surface, and a third surface that extends from a second end, opposite end of the first surface, wherein the cabinet is configured to receive the drawer body through the entrance opening;

a tub that is located inside the drawer body, that defines a space that is configured to store water, and that has a curved outer circumferential surface that is adjacent to the first surface, the second surface, and the third surface;

a drum that is located inside the tub, that is configured to rotate, and that is configured to receive laundry;

a first bent portion that protrudes from the first surface into a space that is between the second surface of the drawer body and the outer circumferential surface of the tub;

a second bent portion that protrudes from the first surface into a space that is between the third surface of the drawer body and the outer circumferential surface of the tub; and a locking unit that is located on the first bent portion, wherein the locking unit comprises:

a transfer member that is movably provided on the first bent portion to be reciprocated up and down with respect to the drawer body;

a first fastening member that is connected with the transfer member and configured to reciprocate left and right with respect to a front of the drawer body in response to the transfer member moving, and that is separably coupled to a portion of an inner circumferential surface of the cabinet that is parallel to the second surface of the drawer body; and a second fastening member that is connected with the transfer member and configured to reciprocate left and right with respect to the front of the drawer body in response to the transfer member moving, and that is separably coupled to a portion of the inner circumferential surface of the cabinet that is parallel to the third surface.

2. The laundry treatment apparatus according to claim 1, wherein:

the first fastening member comprises:

a first bar that is configured to reciprocate left and right with respect to the front of the drawer body in response to the transfer member moving;

a first coupling portion that connects the first bar to the transfer member; and a first end that is separably coupled to the cabinet, and the second fastening member comprises:

a second bar configured to reciprocate left and right with respect to the front of the drawer body in response to the transfer member moving;

a second coupling portion that connects the second bar to the transfer member; and a second end that is separably coupled to the cabinet.

3. The laundry treatment apparatus according to claim 2, wherein the second bar comprises:

a bar body that is located on the second coupling portion and that is located on the first bent portion;

a separable coupling bar portion that is located on the second end and that is located on the second bent portion;

a connection body that is parallel to the first surface of the drawer body;

a first inclined portion that connects the bar body with the connection body and that is inclined toward the first bent portion; and a second inclined portion that connects the separable coupling bar portion with the connection body and that is inclined toward the second bent portion.

4. The laundry treatment apparatus according to claim 3, wherein the transfer member comprises:

a transfer body that is configured to reciprocate up and down with respect to a front of the drawer body and that defines a first slot and a second slot, wherein the first coupling portion is coupled to the first slot, wherein the first slot is configured to guide movement of the first bar in a direction in which the first end is secured to the cabinet in response to the transfer body moving in a first direction, wherein first slot is configured to guide movement of the first bar in a direction in which the first end is separated from the cabinet in response to the transfer body moving in a second direction, wherein the second coupling portion is coupled to the second slot, wherein the second slot is configured to guide movement of the second bar in a direction in which the second end is secured to the cabinet in response to the transfer body moving in the first direction, and wherein the second slot is configured to guide movement of the second bar in a direction in which the second end is separated from the cabinet in response to the transfer body moving in the second direction.

5. The laundry treatment apparatus according to claim 4, further comprising:

a motor that has a rotating shaft;

a body slot in the transfer body that is perpendicular to a reciprocating movement direction of the transfer body;

an arm that is connected to the rotating shaft; and a slot connection portion that is located on the arm, wherein the body slot is configured to receive the slot connection portion, and wherein a length of the body slot is equal to or greater than a diameter of a movement path formed by the slot connection portion.

6. The laundry treatment apparatus according to claim 4, further comprising a transfer body guide that is located on the first bent portion and that is configured to guide movement of the transfer body.

7. The laundry treatment apparatus according to claim 3, further comprising:

a first receiving piece that is located in the cabinet, that separably couples the first end to the first receiving piece, and that is spaced apart from the entrance opening by a first prescribed distance; and a second receiving piece that is located in the cabinet, that separably couples the second end to the second receiving piece, and that is spaced apart from the entrance opening by a second prescribed distance.

8. The laundry treatment apparatus according to claim 2, further comprising a first guide that is located on the first surface and that is configured to guide movement of the second bar.

9. The laundry treatment apparatus according to claim 2, further comprising:

a drawer panel that is connected to the drawer body and that is configured to open or close the entrance opening; and a second guide that protrudes from the drawer panel toward the second bar and that is configured to maintain separation between the second bar and the first surface.

10. The laundry treatment apparatus according to claim 2, further comprising:

a drawer panel that is connected to the drawer body and that is configured to open or close the entrance opening;

a third guide body that extends from the second surface toward the drawer panel;

a third guide body through-hole that is formed in the third guide body and that is configured to receive the first end;

a fourth guide body that extends from the third surface toward the drawer panel; and a fourth guide body through-hole that is formed in the fourth guide body and that is configured to receive second end.

11. The laundry treatment apparatus according to claim 1, further comprising:

a drawer panel that includes a panel front surface that is parallel to a surface of the cabinet that defines the entrance opening, that includes a first side surface that extends from a first end of the panel front surface toward the cabinet, that includes a second side surface that extends from a second, opposite end of the panel front surface toward the cabinet, and a panel upper surface that is located on a top of the panel front surface;

a drive unit that is configured to operate the transfer member; and an unlocking unit that is located on one of the first side surface or the second side surface, that is configured to control the drive unit, and that is configured to separate the first fastening member and the second fastening member from the cabinet.

12. The laundry treatment apparatus according to claim 11, wherein the drive unit is configured to reciprocate the transfer member up and down with respect to a front of the drawer body.

13. The laundry treatment apparatus according to claim 11, further comprising:

a drum drive unit that is configured to rotate the drum;

a control panel that is located on the panel upper surface and that is configured to receive a first control command that operates the drum drive unit; and a controller that is configured to control the drum drive unit in response to a second control command that is input via the control panel and to control the drive unit in response to a third control command that is input via the unlocking unit.

14. The laundry treatment apparatus according to claim 13, further comprising:

a second cabinet that is located on a top of the cabinet and that is configured to prevent at least a portion of the control panel from being visible based on the drawer body being inside the cabinet; and a second laundry accommodation structure that is located inside the second cabinet and that defines a space that is configured for washing or drying laundry.

15. The laundry treatment apparatus according to claim 13, wherein:

the drawer panel further comprises:

a panel through-hole that is formed in one of the first side surface or the second side surface, and wherein the unlocking unit comprises:

a support portion that is connected to an inside of the drawer panel;

a pressure portion that is configured to be inserted into the panel through-hole;

a signal generator that is configured to transmit a control signal to the controller in response to the pressure portion being inserted into the drawer panel; and an expanded portion that is configured to connect the support portion with the pressure portion, that has a larger diameter than the panel through-hole, and that is located between the panel through-hole and the signal generator.

16. The laundry treatment apparatus according to claim 15, wherein the controller is configured to:

separate the first fastening member and the second fastening member from the cabinet and stop operation of the drum drive unit in response to a control command that is input via the unlocking unit by controlling the drive unit.

* * * * *